US006591465B2

(12) United States Patent
Suyama

(10) Patent No.: US 6,591,465 B2
(45) Date of Patent: Jul. 15, 2003

(54) LATCHING APPARATUS FOR INFLATABLE BELT DEVICE

(75) Inventor: Yoji Suyama, Tokyo (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 09/794,152

(22) Filed: Feb. 28, 2001

(65) Prior Publication Data

US 2001/0034929 A1 Nov. 1, 2001

(30) Foreign Application Priority Data

Mar. 2, 2000 (JP) ..... 2000-056621
Nov. 15, 2000 (JP) ..... 2000-347772

(51) Int. Cl.[7] ..... A44B 11/25; B60R 21/18

(52) U.S. Cl. ..... 24/633; 24/636; 24/637; 280/733

(58) Field of Search ..... 24/633–642; 280/733, 280/751, 748, 801.1, 801.2, 808

(56) References Cited

U.S. PATENT DOCUMENTS 3,682,498 A * 8/1972 Rutzki ..... 280/733
3,791,670 A * 2/1974 Lucore et al. ..... 280/733
3,929,348 A * 12/1975 Lawwill ..... 280/733
5,385,367 A * 1/1995 Tanaka et al. ..... 280/733
6,019,388 A * 2/2000 Okazaki et al. ..... 280/733
6,062,597 A * 5/2000 Suyama ..... 280/733
6,082,763 A * 7/2000 Kokeguchi ..... 280/733
6,116,637 A * 9/2000 Takeuchi et al. ..... 280/733
6,126,194 A * 10/2000 Yaniv et al. ..... 280/733
6,142,512 A * 11/2000 Suyama ..... 280/733
6,168,196 B1 * 1/2001 Nariyasu ..... 280/733
6,220,626 B1 * 4/2001 Utsumi et al. ..... 280/733
6,237,946 B1 * 5/2001 Nariyasu ..... 280/733

FOREIGN PATENT DOCUMENTS

JP 406262997 A * 3/1993 ..... 280/733
JP 405112201 A * 5/1993 ..... 280/733

* cited by examiner

*Primary Examiner*—Robert J. Sandy
*Assistant Examiner*—Ruth C. Rodriguez
(74) *Attorney, Agent, or Firm*—Foley & Lardner

(57) ABSTRACT

A latching apparatus for an inflatable belt device which achieves reduction in the gas leakage without losing the smoothness of insertion of a tongue into a buckle, or which achieves reduction in the manufacturing cost and the weight of the latching apparatus. A tongue and a buckle of a latching apparatus for an inflatable belt device have pipes (a tongue pipe, a buckle pipe), through which gas for deploying an inflatable belt flows. The end of the buckle pipe is covered by a buckle cap which is broken when an inflator is actuated. The buckle cap is biased upwardly by a spring fitted around the buckle pipe. A space between the pipes is eliminated by the buckle cap, thereby achieving the reduction in gas leakage. Therefore, the need for excess gas is eliminated, thereby enabling miniaturization of the inflator.

7 Claims, 13 Drawing Sheets

LATCHING APPARATUS FOR INFLATABLE BELT DEVICE

BACKGROUND OF THE INVENTION

The present invention relates to a latching apparatus for an inflatable belt device which achieves reduction of gas leakage without losing the smoothness of insertion of the tongue into the buckle, or reduction in the manufacturing cost and the weight of the latching apparatus. More particularly, the present invention relates to a latching apparatus for an inflatable belt device comprising a tongue and a buckle through which gas generated from an inflator is supplied to a cushion., Currently, a seat belt is the most commonly used as a device for restraining an occupant in a vehicle seat in the event of emergency. A typical seat belt device comprises a shoulder webbing to be extended diagonally across the chest from the shoulder to the waist of an occupant, a lap webbing to be extended across the lap in front of the waist of the occupant, the shoulder webbing and the lap webbing being integral as one strip. The proximal end of the shoulder webbing is connected to a seat belt retractor. The retractor prevents the shoulder belt from being withdrawn when an abnormal deceleration is exerted on a vehicle. When locked, the shoulder belt blocks the frontward movement of the occupant.

In recent years, seat belt devices have been refined to further intensify the function of protecting occupants by adding the following techniques:

(1) a pretensioner which rapidly remove slack from the webbing in the event of emergency to achieve initial restraint of the occupant; and (2) an energy absorbing mechanism (hereinafter, referred to as "EA mechanism") which allows the webbing to be gradually withdrawn to absorb inertia energy of the occupant when the tension on the webbing exceeds a predetermined value.

However, there remains a need for achieving more soft protection of the occupant by reducing the pressures to the shoulder and the chest of the occupant.

In order to meet this need an inflatable belt device has been developed. The conventional inflatable belt device is a seat belt, of which a portion of a shoulder webbing that touches the shoulder and chest of an occupant's body is composed of an inflatable bag. For example, the bag may be inflated to have a diameter of 14 cm in order to function as an air cushion, thereby softening the pressure exerted on the occupant's body. The bag is shortened in the longitudinal direction when inflated in order to remove the slack from the webbing. In this manner, the inflatable belt also functions as a seat belt pretensioner. Furthermore, the inflatable belt device can also function as an EA mechanism by gradually exhausting gas in the bag at appropriate times. It is expected that inflatable belt devices will increase in popularity due to their improved safety capacity as compared to current seat belt devices.

In general, an inflatable belt device may include a latching apparatus for connecting a seat belt device and a vehicle body. The latching apparatus generally comprises a buckle connected to a vehicle body (e.g. seat frame) and a tongue connected to an end of the inflatable belt. The buckle has a tongue latching mechanism for allowing detachable latching of the tongue.

Inflators for inflating a bag of an inflatable belt device generally include two types. One type is connected to an upper portion of the bag (arranged above the shoulder of the occupant) and the other type is connected to a lower portion of the bag (arranged below the lap of the occupant). In some of the second type of inflators, gas generated by the inflator is supplied into the bag through a buckle. The buckle and a tongue have gas passages, respectively, through which gas generated by the inflator is passed. These passages are designed to communicate with each other when the tongue is inserted to the buckle.

SUMMARY OF THE INVENTION

The inflatable belt mentioned above may be improved in several ways. In order to improve the smoothness of insertion of tongue into the buckle, a suitable clearance should be formed between the tongue and a tongue insertion opening of the buckle in the normal used state of a seat belt. In order to minimize gas leakage, gas generated by the inflator should be supplied into the bag through the passages of the buckle and the tongue without gas leakage when the inflatable belt is deployed (in the event of vehicle collision). Furthermore, easy detachment of the tongue from the buckle should be allowed after the vehicle collision.

An inflatable belt device that satisfies the above points may include a buckle having a gas passage of which one end is positioned inside the buckle so as not to project in the normal used state. The gas passage is arranged to project into the tongue only at the start of vehicle collision and to return to the inside of the buckle by pressure inside the bag during a period between the vehicle collision and the end of the vehicle collision.

In order to cope with a vehicle collision of relatively long period of time (for example, a roll-over that needs to restrain an occupant for several seconds of time), it is required to increase the capacity (molecular amounts of gas) of the inflator to maintain the pressure in the bag. However, the size and the weight of the inflator are increased with increase in the capacity of the inflator, thus also increasing the manufacturing cost. The inflator should be designed to have enough capacity to account for any gas leakage between the buckle and the tongue.

The present invention has been made to solve the aforementioned problems by providing a latching apparatus for an inflatable belt device which achieves reduction in the gas leakage without losing the smoothness of insertion of a tongue into a buckle, and which achieves reduction in the manufacturing cost and the weight of the latching apparatus.

It is to be understood that both the foregoing general description and the following detailed description are exemplary and explanatory only, and are not restrictive of the invention as claimed.

BRIEF DESCRIPTION OF THE DRAWINGS

These and other features, aspects and advantages of the present invention will become apparent from the following description, appended claims, and the accompanying exemplary embodiments shown in the drawings, which are briefly described below.

DETAILED DESCRIPTION

Although references are made below to directions, such as left, right, up, down, etc., in describing the drawings, they are reference relative to the drawings (as normally viewed) for convenience. These directions are not intended to be taken literally or limit the present invention in any form.

Figure 7:
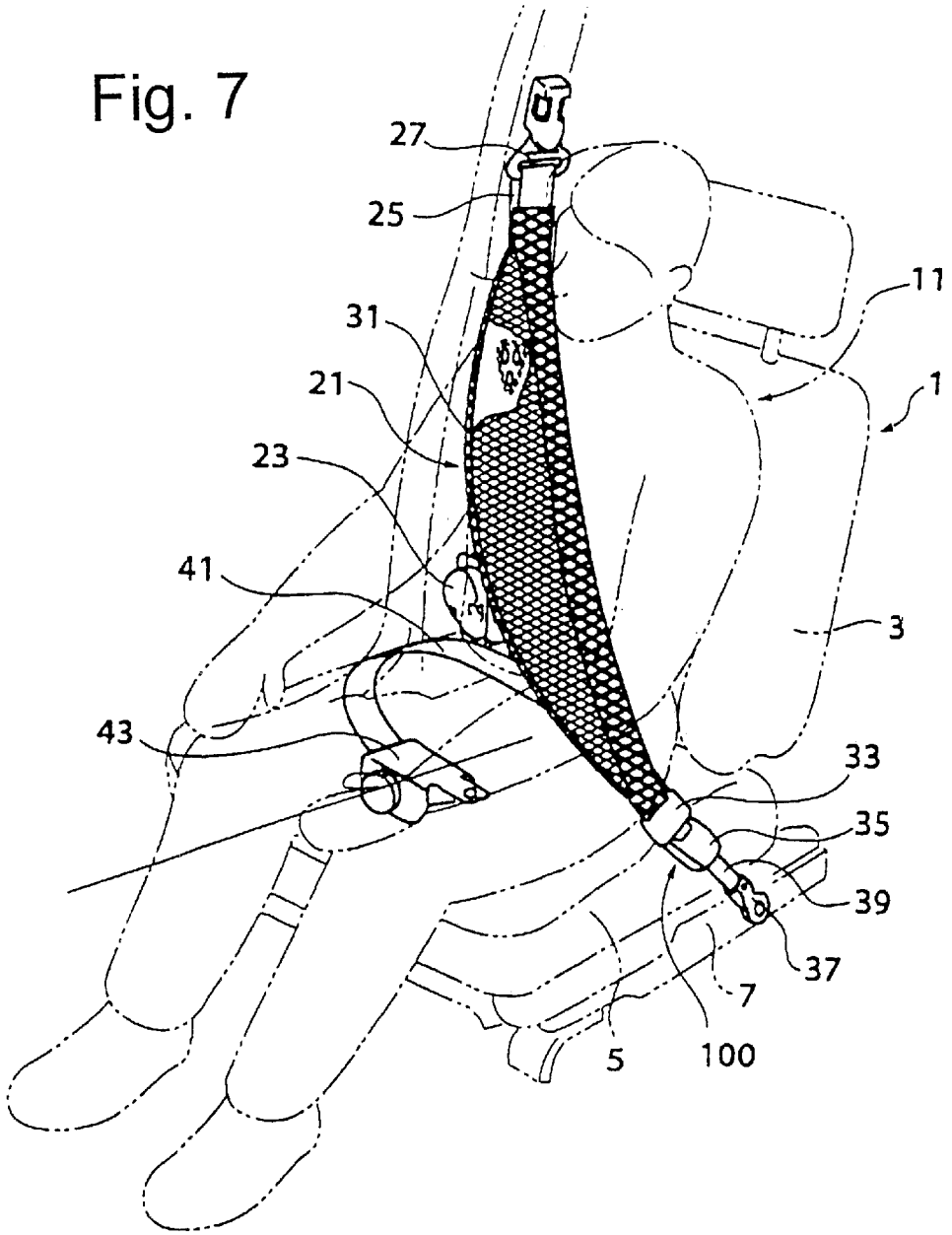
FIG. 7 is a schematic perspective view showing the entire structure of the inflatable belt device according to an embodiment of the present invention and also showing its bag deployed state.

In FIG. 7, an occupant 11 is shown in a state sitting on a seat 1. The seat 1 includes a seat squab 5 on which the occupant 11 sits and a seat back 3. Arranged below the seat squab 5 is a seat frame 7 for supporting the seat 1 and connecting the seat 1 to a vehicle body.

An inflatable belt device 21 comprises the following components: an inflatable belt 31 which is extended diagonally across the chest from the shoulder to the waist of the occupant 11 when the occupant 11 puts on the inflatable belt device 21; a shoulder webbing 25 which is connected to the upper end of the inflatable belt 31 and is composed of a band-like webbing just like a webbing of a normal seat belt; a deflector 27 for deflecting the shoulder webbing 25; a retractor 23 for winding up the shoulder webbing 25 and for stopping the shoulder webbing 25 from being withdrawn in the event of emergency; a tongue 33 which is connected to a lower end portion of the inflatable belt 31 to connect the inflatable belt 31 to the vehicle body through a buckle 35; the buckle 35 which is fixed to the seat frame 7 through an inflator 39 and an anchor bracket 37; the inflator 39 for generating gas for inflating the inflatable belt 31; a lap webbing 41 which is extended across the lap of the occupant; a retractor 43 for winding up the lap webbing 41 and for stopping the lap webbing 41 from being withdrawn in the event of emergency; and an acceleration sensor and an electric circuit for actuating the inflator 39 in the event of emergency.

The inflatable belt device 21 is characterized by the structure of the gas passages of the tongue 33 and the buckle 35. The structure will be described in detail with reference to FIG. 1 through FIG. 6.

Figure 5:
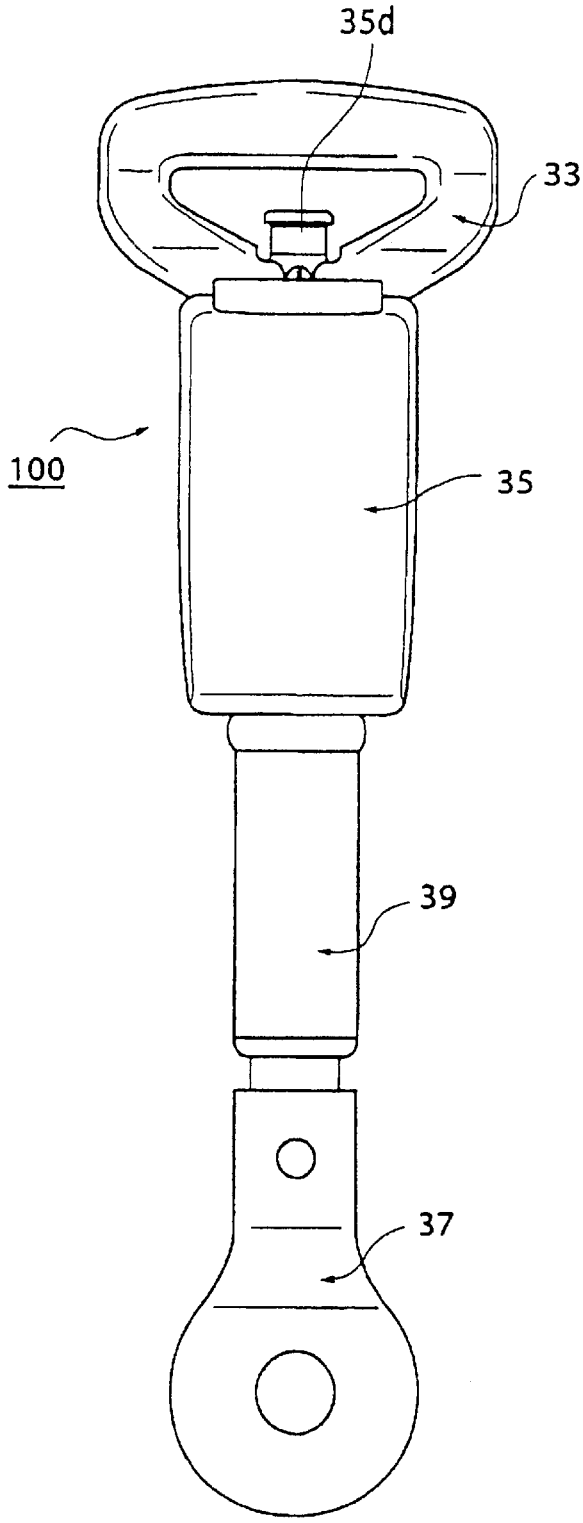
FIG. 5 is a front view showing the entire structure of the latching apparatus for the inflatable belt device of the embodiment.

As shown in FIG. 5, the latching apparatus 100 of the inflatable belt device 21 comprises the tongue 33 and the buckle 35. The inflator 39 is connected to a lower portion of the buckle 35 by screws. Disposed on the lower end of the inflator 39 is an anchor bracket 37.

Figure 4:
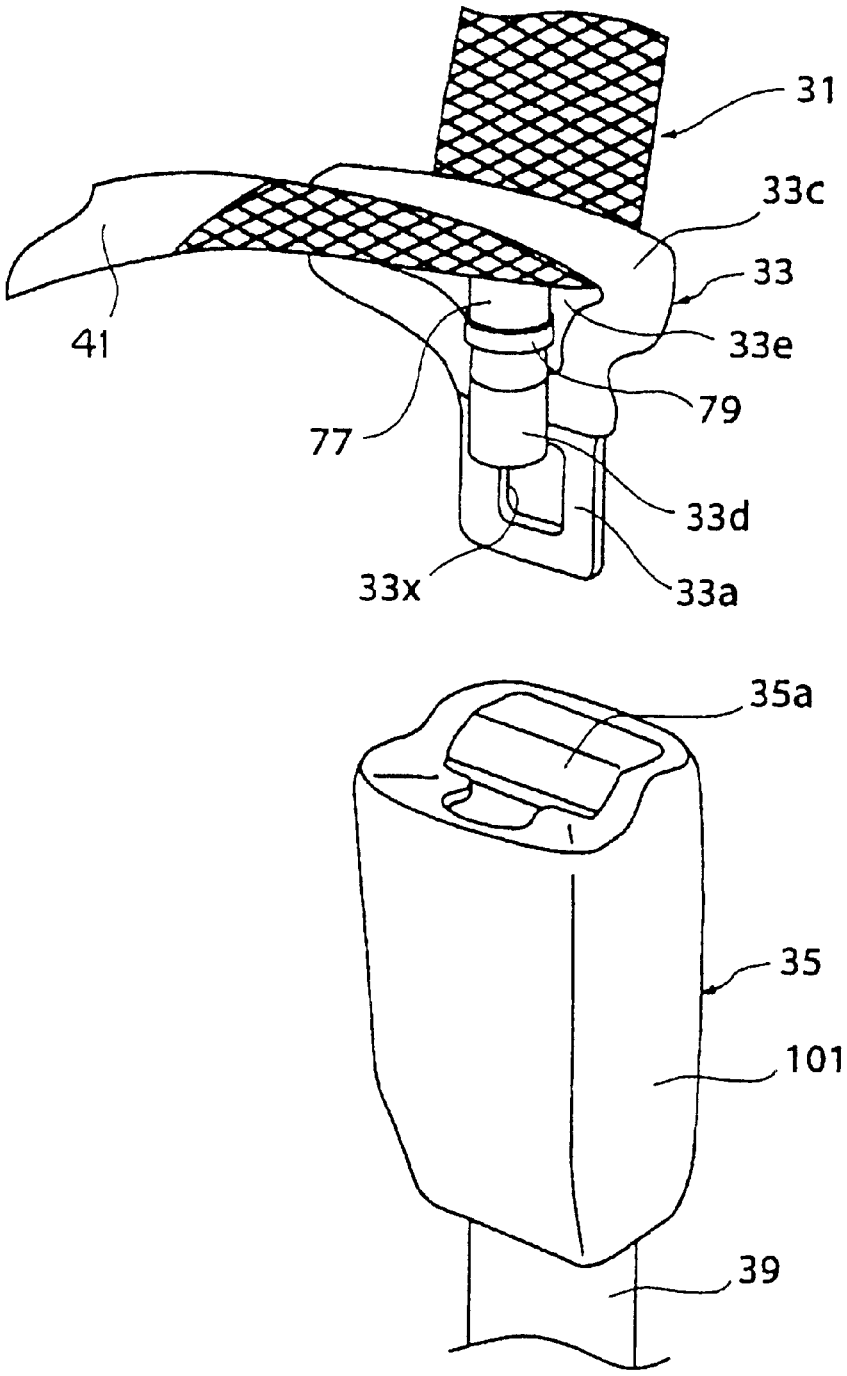
FIG. 4 is a perspective view showing the appearance of the tongue and the buckle.

As shown in FIG. 4, the tongue 33 has a tongue plate 33*a* to be inserted into the buckle 35, a hanger portion 33*c*, and a tongue pipe 33*d*. The tongue plate 33*a* is engaged with a latch 131 of a tongue latching mechanism 110 in the buckle 35 as described later. The hanger portion 33*c* is formed with a slit 33*e*. The lap webbing 41, described further below, is inserted through the slit 33*e*.

Figure 1:
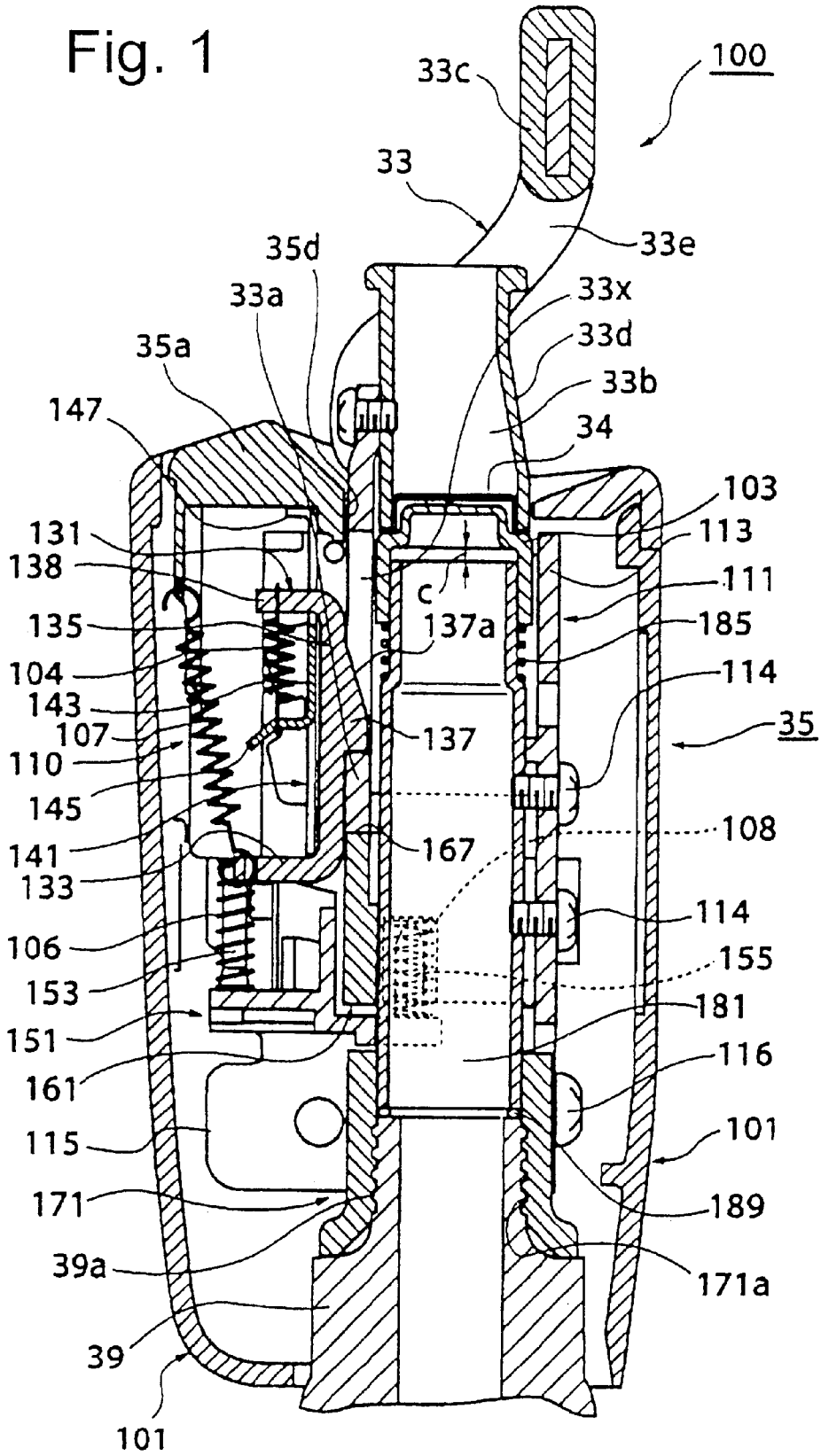
FIG. 1 is a sectional view showing the structure of a latching apparatus for an inflatable belt device of the embodiment, in a state that a tongue is latched to a buckle.
Figure 3:
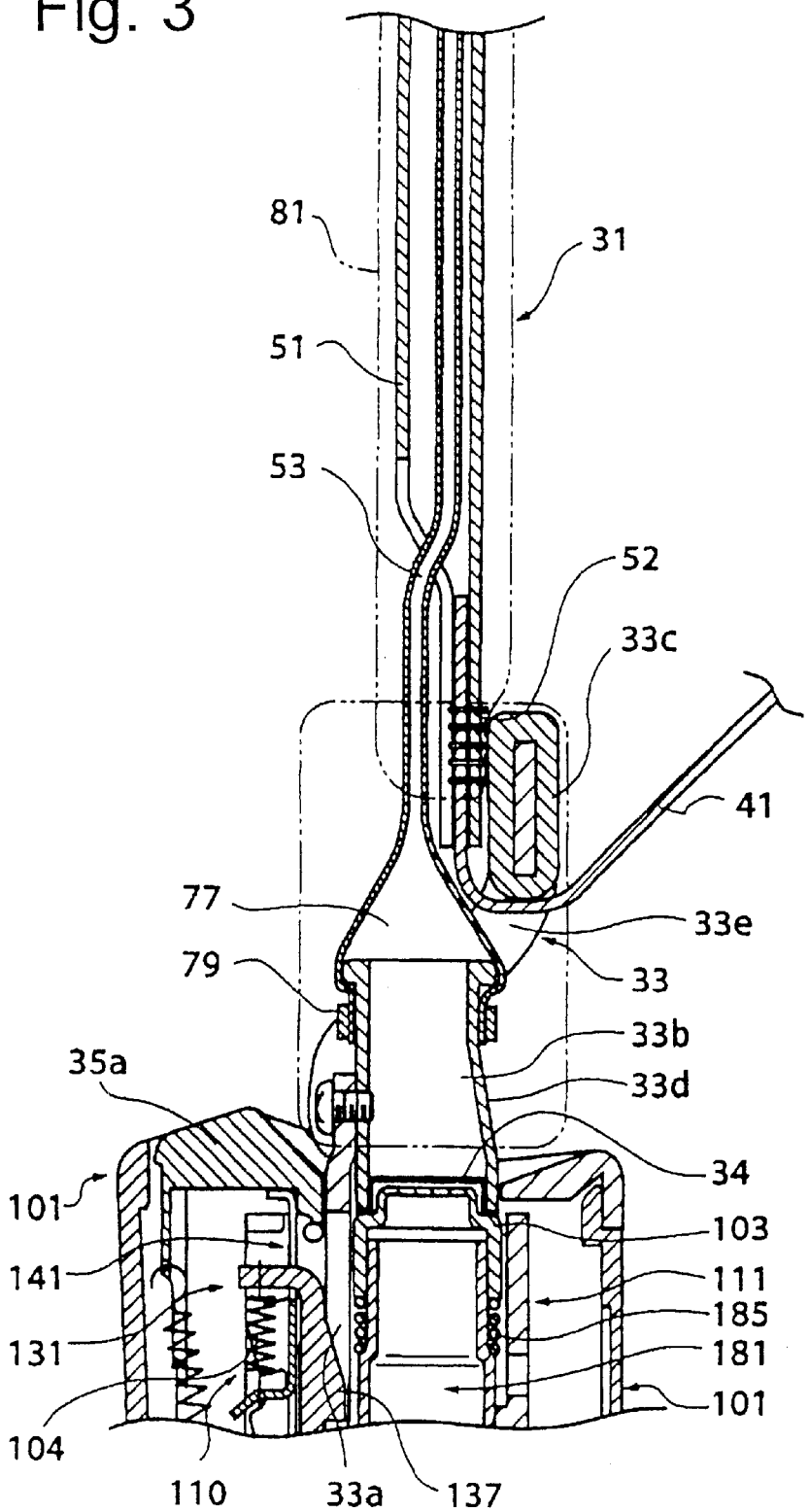
FIG. 3 is a sectional view showing the connecting relation among an inflatable belt, the tongue, and an upper portion of the buckle of the inflatable belt device.

The tongue pipe 33*d* is provided at the center in the width direction of the tongue 33. As shown in FIG. 3, connected to the upper end of the tongue pipe 33*d* is a gas inlet 77 (described further below) for the inflatable bag 53. The tongue pipe 33*d* has a gas passage 33*b* formed inside thereof. As shown in FIG. 3, the gas passage 33*b* is formed to communicate with the inside of the bag 53. As shown in FIG. 1 and FIG. 3, a tongue cap 34 made of aluminum is fitted in a lower end opening of the tongue pipe 33*d*. The tongue cap 34 is depressed into the gas passage 33*b* of the tongue pipe 33*d* and is engaged with an edge of the lower end opening of the tongue pipe 33*d*. The tongue cap 34 is designed to give way or rupture when confronted by the gas emitted by the inflator 39. The tongue cap 34 also functions as a screen gate for preventing dust from invading into the tongue pipe 33*d*.

Figure 2:
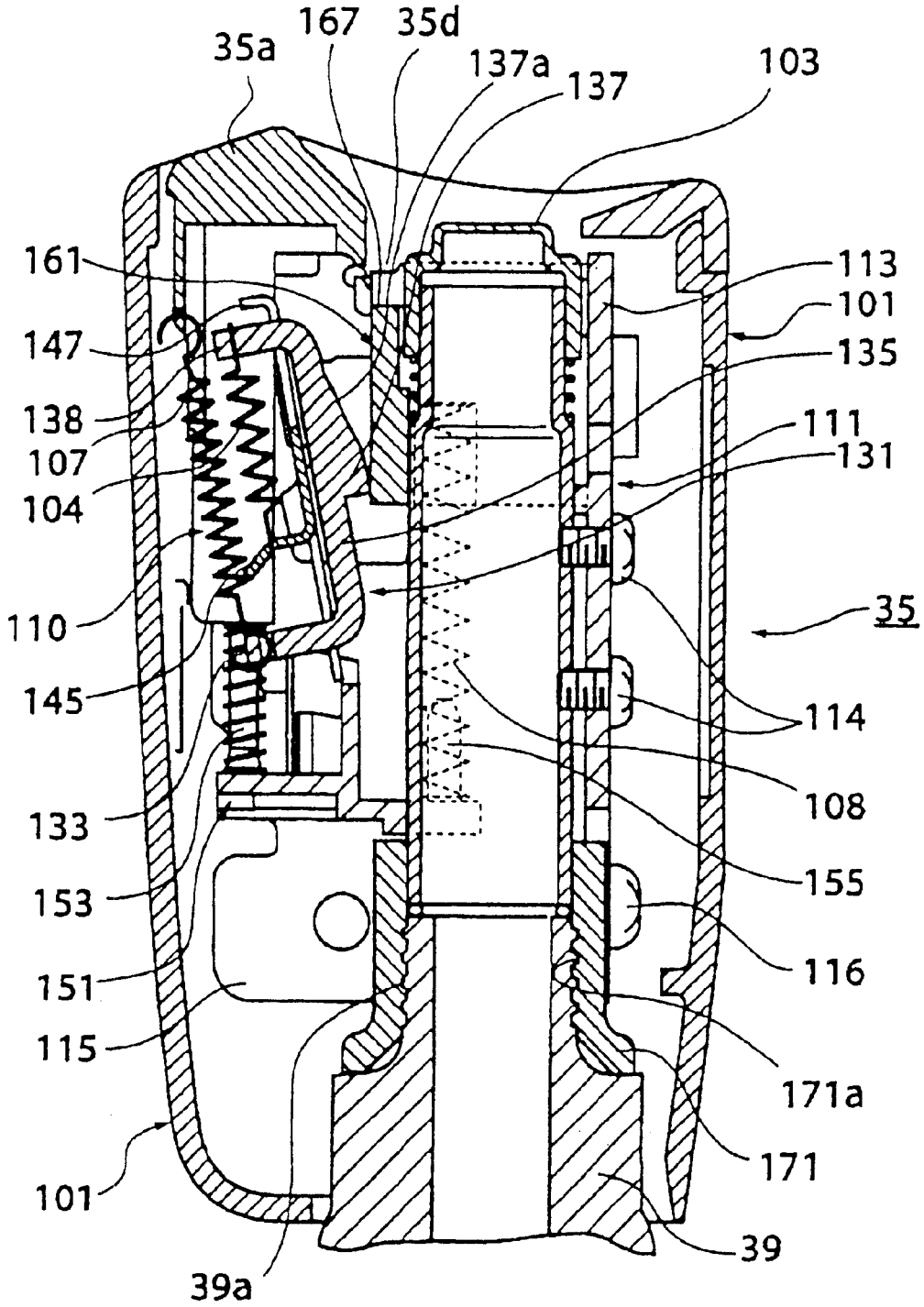
FIG. 2 is an enlarged sectional view of the buckle in a state that the tongue is released.

As shown in FIG. 1 and FIG. 2, the buckle 35 comprises an outer cover 101. The cover 101 is formed at its upper portion with an upper opening 35*d* for the insertion of the tongue plate 33*a*. The tongue latching mechanism 110 is provided inside the cover 101 for engaging the tongue plate 33*a* when inserted. The cover 101 is provided at its upper portion with a release button 35*a*. As the button 35*a* is depressed, the tongue latching mechanism 110 is released so as to push out the tongue 33 upwardly.

Figure 6:
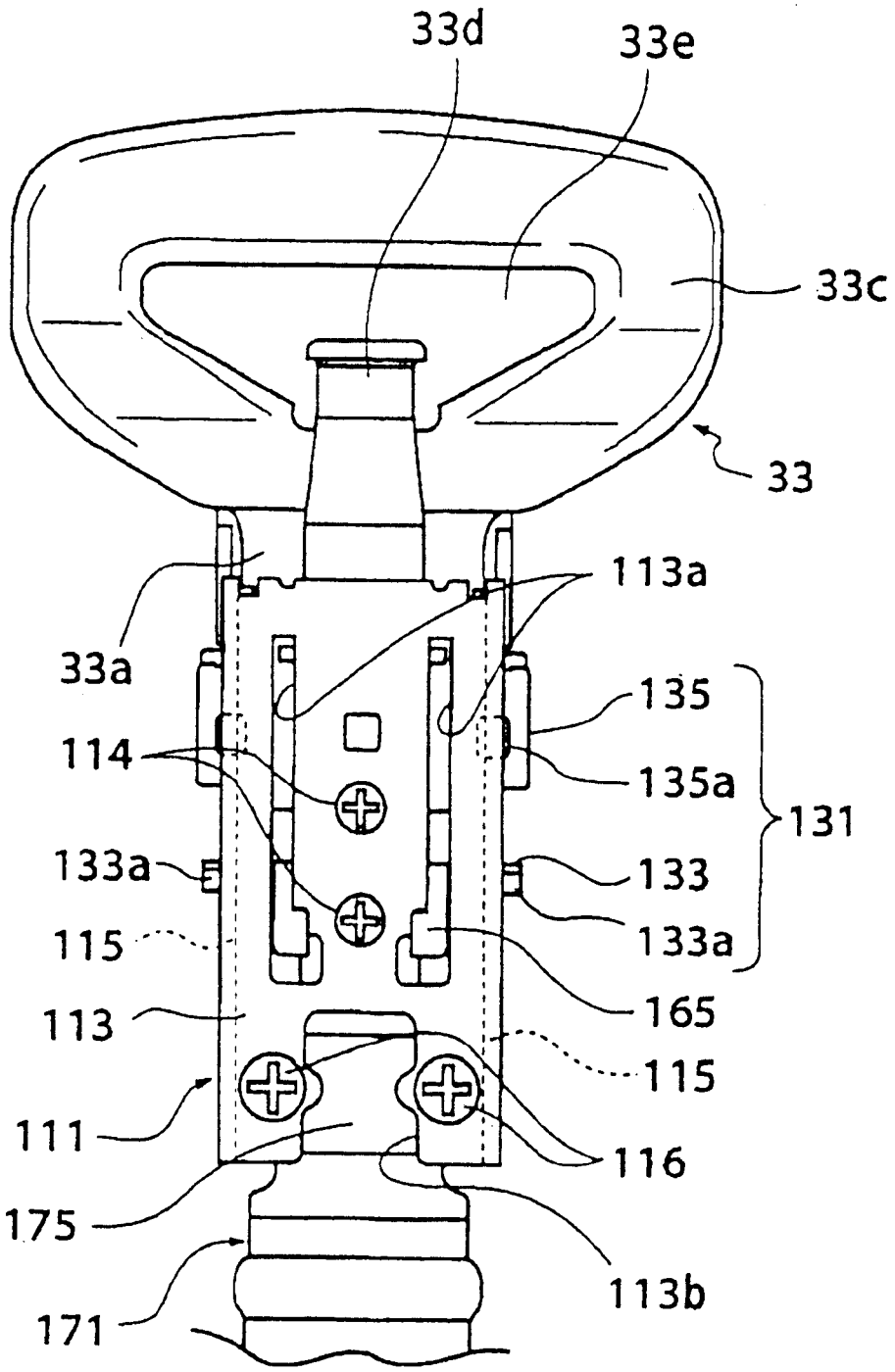
FIG. 6 is a view showing a rear side of the latching apparatus in a state that a cover of the buckle is removed.

As shown in FIG. 6, the tongue latching mechanism 110 comprises a buckle base 111 made of steel. The buckle base 111 functions as a main rigid member against a force drawing out the inflatable belt 31. The buckle base 111 is a substantially U-shaped member having a base plate 113 and two side plates 115. The base plate 113 is formed with two slits 113*a* parallel to each other. Projections 165 of an ejector 161, further described below, fit and slide into the slits 113*a*. The base plate 113 is formed at its lower portion with a cutout 113*b* into which an external stopper 175 of an inflator connecting member (duct) 171, described later is fitted. Screws 114 for fixing a buckle pipe 181 and screws 116 for fixing an inflator connecting member are screwed into the base plate 113.

The latch 131 is held between the side plates 115 of the buckle base 111. The latch 131 presses down the tongue plate 33*a* when the tongue 33 is latched (see FIG. 1). As shown in FIGS. 1, 2, and 6, the latch 131 has a pivot portion 133 and a movable portion 135. The pivot portion 133 of the latch 131 has lateral protrusions 133*a*. The protrusions 133*a* function as a pivot axis for the latch 131. The movable portion 135 of the latch 133 is formed with left-side and right-side windows 135*a* as shown in FIG. 6. The windows 135*a* are closed by a sliding member 141 when the tongue 33 is latched (as shown in FIG. 1) and are opened when the tongue 33 is not latched (as shown in FIG. 2). In the opened state, pawls (not shown) of the side plates 115 enter into the windows 135*a*.

The back (a right-side surface in FIG. 1 and FIG. 2) of the latch 131 is formed with a tongue engaging projection 137. The engaging projection 137 is engaged with the tongue plate 33 when the tongue 33 is latched (as shown in FIG. 1). The latch engaging projection 137 has a tapered portion 137*a* formed on an upper portion thereof. In addition, the latch 131 has a spring hook 138 formed on the upper end thereof. Attached to the spring hook 138 is a spring 104 for connecting and biasing the latch 131 and a sliding member 141. The latch 131 and the release button 35*a* are connected and biased by a button spring 107. The connecting state among the ends of the button spring 107, the latch 131, and the release button 35*a* is schematically shown. The button spring 107 biases the release button 35*a* in the downward direction and biases the latch 131 to stand upright.

As shown in FIG. 1 and FIG. 2, slidably fitted to the left side of the latch 131 (the left side in FIG. 1 and FIG. 2) is a sliding member 141. The sliding member 141 has lateral protrusions 143. The protrusions 143 close the windows 135*a* (see FIG. 6) of the latch 131 when the tongue 33 is latched (in the state shown in FIG. 1) and are positioned below the windows 135*a* of the latch 131 so that the windows 135*a* are opened when the tongue 33 is not latched (in the state shown in FIG. 2). The sliding member 141 has a spring hook 145 formed substantially at its central portion. A spring 104 is disposed between the spring hook 145 and the spring hook 138 of the latch 131. By this spring 104, the slider 141 is biased upwardly (toward the position where the windows 135*a* are closed). The sliding member 141 is formed at its upper end with a humulus-like contact portion 147. The contact portion 147 comes in contact with the inner side of the release button 35*a* when the tongue 33 is latched (as shown in FIG. 1).

The ejector 161 having a U-like shape in its plan view is held inside the buckle base 111 in such a manner that the ejector 161 can slide along the vertical direction. The ejector 161 is formed to have a dimension larger than the outer diameter of the buckle pipe 181. The ejector 161 has two projections 165, as shown in FIG. 6, formed on the edge of the opening inside the U-like shape. The projections 165 are slidably fitted in the slits 113*a* of the buckle base 111. The ejector 161 has an arc-like contact portion 167 formed on the upper end of a surface, opposite to the projections 165, (the left-side surface in FIG. 1 and FIG. 2) of the ejector 161. The lower end of the tongue plate 33*a* comes in contact with the contact portion 167 when the tongue 33 is latched. The ejector 161 has spring holes (not shown) fitted to the upper ends of springs 108, described further below.

As shown in FIG. 1 and FIG. 2, the buckle pipe 181 is disposed between the base plate 113 and the ejector 161 substantially at the center of the inside of the buckle base 111. The buckle pipe 181 is fixed to the base plate 113 of the buckle base 111 by screws 114. The buckle pipe 181 is a gas passage through which gas spouted out from the inflator 39 passes into the inflatable belt 31.

A buckle cap 103 made of aluminum is put on the upper end of the buckle pipe 181. The buckle cap 103 is formed with tear lines (not shown). The upper end of the buckle pipe 181 is normally closed by the buckle cap 103. When the inflatable belt device is actuated, however, the buckle cap 103 is broken along its tear lines by gas pressure generated by the inflator 39. As shown in FIG. 1, there is a clearance (over stroke) C between the inner surface of the buckle cap 103 and the upper end of the buckle pipe 181, and this clearance absorbs the tolerance among parts and backlash during the insertion of the tongue 33.

The buckle cap 103 is biased upwardly by the spring 185 fitted around the buckle pipe 181. Because of the biasing force of the spring 185, the upper end of the buckle pipe 181 and the lower end of the tongue pipe 33*d* of the tongue 33 are closely in contact with each other when the tongue 33 is latched. The upper end of the inflator 39 is connected to the lower end of the buckle pipe 181 via an O-ring 189.

To prevent the buckle cap 103 from coming off the buckle pipe 181, a flange (not shown) of the buckle cap 103 is stopped by pawls (not shown) extending from the buckle base 111.

This embodiment is designed so that the tongue pipe 33*d* of the tongue 33 and the buckle pipe 181 of the buckle 35 are coaxially aligned and connected to each other substantially at the center in the width direction when the tongue 33 is latched. At this point, in the joint portion between the pipes 33*d* and 181, the buckle cap 103 is biased toward the tongue cap 34 by the spring 185 so that a space between the pips 33*d* and 181 is eliminated. Since the space is eliminated, gas leakage during the operation of the inflator 39 can be reduced.

As shown in FIG. 1 and FIG. 2, a holder 151 is disposed inside the buckle base 111 below the latch 131 and the sliding member 141. The holder 151 has projections 155 formed on a right side portion thereof (the right side in FIG. 1 and FIG. 2) to project upwardly. The springs 108 are fitted around the projections 155. The upper ends of the springs 108 are fitted to the spring holes (not shown) formed in the bottom of the ejector 161. The ejector 161 is biased upwardly by the biasing force of the springs 108 so that the ejector 161 is risen when the tongue 33 is not latched, as shown in FIG. 2.

The holder 151 has two guide poles 153 arranged along the width direction (the depth direction in FIG. 1 and FIG. 2) to stand upwardly on a left side portion thereof (the left side in FIG. 1 and FIG. 2). Guide holes (not shown) of the release button 35*a* slide along the guide poles 153. Springs 106 are fitted around the guide poles 153, respectively. The upper ends of the spring 106 are in contact with the bottom of the release button 35*a*. The release button 35*a* is biased upwardly by the biasing force of the springs 106.

As shown in FIG. 1 and FIG. 2, the cylindrical duct 171 is attached to the buckle base 111 below the holder 151. The duct 171 is formed in its lower inner surface with an internal thread 171*a* (see FIG. 1 and FIG. 2). Screwed into this internal thread 171*a* is an external thread 39*a* (see FIG. 1 and FIG. 2) formed in an upper end portion of the inflator 39. The duct 171 has the external stopper 175 formed on an end portion thereof as shown in FIG. 6. The external stopper 175 is formed in a drum-like shape with a neck portion and is fitted to the cutout 113*b* of the base plate 113 of the buckle base 111. Force of drawing the tongue is transmitted to the duct 171 and the inflator 39 through this joint portion. The duct 171 and the buckle base 111 are fixed to each other by the screws 116.

As shown in FIG. 1 and FIG. 2, the upper end of the inflator 39 is connected to the lower end of the buckle pipe 181 of the buckle 35 via the duct 171. When the inflator 39 is ignited in the event of vehicle collision, the inflator 39 spouts out gas for deploying the bag toward the gas passage 35*c* of the buckle 35. The gas is emitted into the hollow portion of the bag through the tongue pipe 33*d* (see FIG. 3) of the tongue 33 after passing through the inside of the buckle pipe 181.

The upper end portion of the inflator 39 is tapered and has the external thread 39*a* formed in the outer surface thereof. The external thread 39*a* is screwed into the internal thread 171*a* of the duct 171. The inflator 39 includes a propellant and an initiator (not shown) therein. The anchor bracket 37 is provided at the lower end of the inflator 39 as shown in FIG. 5. The bracket 37 is fixed to the seat frame by bolts or the like. Though the anchor bracket 37 is formed integrally with the body of the inflator 39 in this embodiment, it may be formed separately from the inflator and may be connected by bolts or clamps. It should be noted that the inflator 39 and the bracket 37 may be connected by crimping.

As shown in FIG. 3, the inflatable belt 31 is composed of three layer elements. The three layer elements in the order from the inside to the outside are: a bag 53, a mesh webbing 51, and a cover 81. The bag 53 is made by forming (bonding, sewing) for example, nylon plain wave fabric, on which silicone resin is coated, into an envelope shape. The bag 53 is covered by the mesh webbing 51 from the outside. The mesh webbing 51 is formed by knitting, for example, polyester yarns into a cylindrical shape. When the bag 53 is deployed, the mesh webbing 51 expands along the outer surface of the bag 53. At this point, the mesh webbing 51 shrinks in the longitudinal direction, thereby removing slack from the webbing and imparting pre-tension on the webbing. It should be noted that the bag 53 itself also shrinks in the longitudinal direction during its deployment.

The mesh webbing 51 is covered by the cover 81 from the outside. The cover 81 may be made of polyester plain wave fabric. The cover 81 is torn during the deployment of the bag 53. The cover 81 is used for accommodating the inflatable belt 31 in a compact form and for making the inflatable belt 31 comfortable to the occupant.

The bag 53 has the gas inlet 77 formed in the lower end thereof. The lower end of the mesh webbing 51 is sewn to the end of the lap webbing 41 by sewing (sewing portion 52).

The inflatable belt 31 and the tongue 33 are connected to each other by the following method. That is, as shown in FIG. 3, the tongue pipe 33*d* of the tongue 33 is inserted into the gas inlet 77 of the bag 53. The tongue pipe 33*d* and the gas inlet 77 are fastened and fixed by a clamping band 79. The lap webbing 41 connected to the mesh webbing 51 by sewing is passed through the slit 33*e* of the hanger portion 33*c*.

Hereinafter, the actions of the inflatable belt device 21 having the aforementioned construction will be described with reference to FIG. 1 and FIG. 2 mainly.

When the tongue 33 is not latched to the buckle 35, as shown in FIG. 2, the ejector 161 is pressed upwardly by the biasing force of the springs 108 so that it is in an upward position. At this point, the side of the ejector 161 is in contact with the engaging projection 137 of the latch 131 so that the latch 131 tilts leftward.

To latch the tongue 33 to the buckle 35, the tongue plate 33*a* of the tongue 33 is inserted into the upper opening 35*d* of the buckle 35. At this point, the lower edge of the tongue plate 33*a* comes in contact with the contact portion 167 of the ejector 161. The ejector 161 is depressed against the biasing force of the springs 108. Then, as shown in FIG. 1, the ejector 161 is lowered below the engaging projection 137 of the latch 131 and the tongue plate 33*a* is also lowered below the engaging projection 137 so that the projection 137 enters into a tongue plate hole 33*x* of the tongue plate 33*a*. In this way, the tongue plate 33*a* and the latch 131 are latched. The latch 131 is biased by the button spring 107 so as to stand upright as shown in FIG. 1. At this point, the sliding member 141 is biased by the compressing force of the spring 104 to move upwardly so as to close the windows 135*a* (FIG. 6) of the latch movable portion 135. This configuration prevents the latch 131 from tilting leftward and prevents the tongue plate 33*a* from coming off.

When the buckle 35 and the tongue 33 are connected to each other, as shown in FIG. 1, the tongue pipe 33*d* of the tongue 33 and the buckle pipe 181 of the buckle 35 are aligned coaxially and connected to each other substantially at the center in the width direction. The buckle cap 103 on the upper end of the buckle pipe 181 is biased upwardly by the spring 185 and is thus pressed against the tongue cap 34 of the lower end of the tongue pipe 33*d*. Therefore, the upper end of the buckle pipe 181 and the lower end of the tongue pipe 33*d* are connected closely to each other. It should be noted that the tolerance among parts and backlash during the insertion of the tongue 33 can be absorbed by the clearance C inside the buckle cap 103.

When gas is emitted out from the inflator 39, the gas breaks the buckle cap 103 on the upper end of the buckle pipe 181 along the tear lines, further breaks the tongue cap 34, and is supplied into the bag 53 through the tongue pipe 33*d*. Since there is no space between the upper end of the buckle pipe 181 and the lower end of the tongue pipe 33*d*, i.e. these are closely connected, it achieves the reduction in gas leakage during the actuation of the inflator 39.

Hereinafter, another embodiment of the latching apparatus for the inflatable belt device according to the present invention will be described with reference to FIG. 8 through FIG. 13. A feature of the latching apparatus 200 of this embodiment that differs from the latching apparatus 100 of the aforementioned embodiment is that the gas passages of the tongue and the buckle are arranged on a side not the center.

In the respective drawings, the up and down direction when the apparatus is installed in a vehicle is indicated by arrows.

Figure 8:
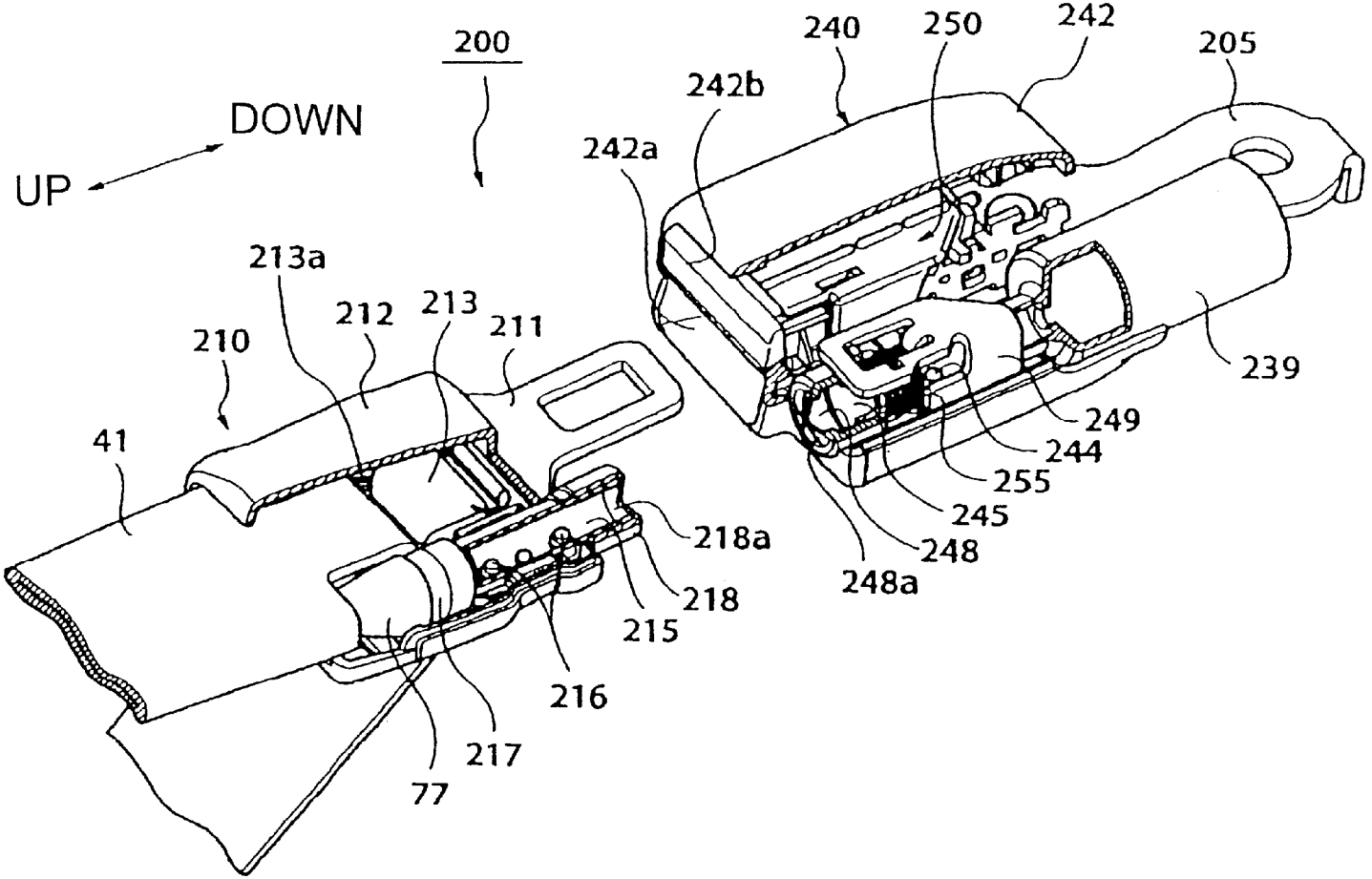
FIG. 8 is a perspective view, partially cutaway, showing the structure of this embodiment of the latching apparatus for the inflatable belt device according to the present invention, FIG. 8 showing a state that a buckle and a tongue are separated away.
Figure 9:
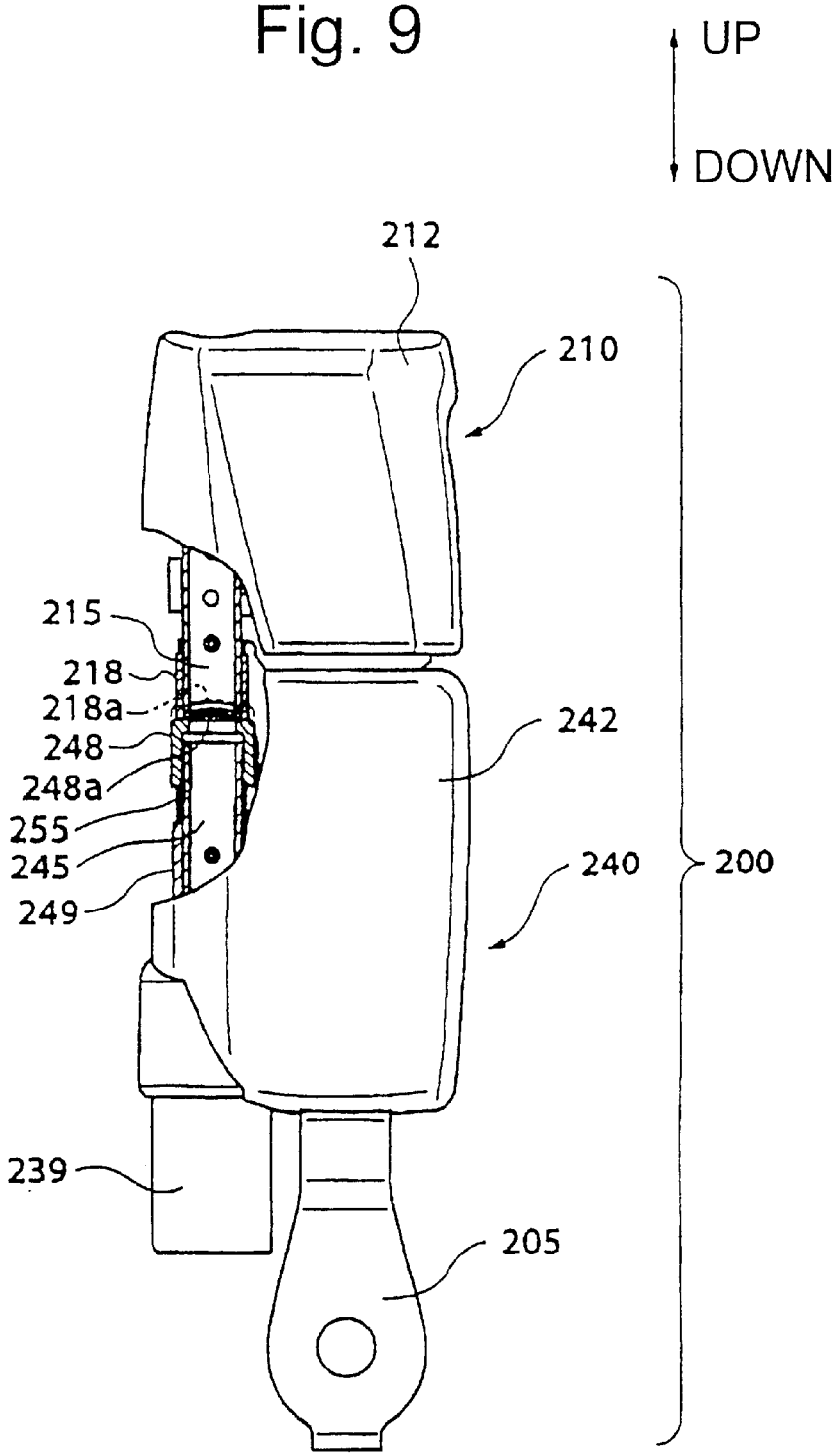
FIG. 9 is a front view, partially cutaway, showing the entire structure of the latching apparatus for the inflatable belt device shown in FIG. 8.

As shown in FIG. 8 and FIG. 9, the latching apparatus 200 of this embodiment comprises a tongue 210 and a buckle 240. Disposed below the buckle 240 is an anchor bracket 205.

The tongue 210 has an outer casing 212. The tongue 210 is provided at its lower end with a tongue plate 211 which is inserted into the buckle 240. The tongue plate 211 is latched to a tongue latching mechanism 250 of the buckle 240. A hanger portion 213 is arranged inside the casing 212. The hanger portion 213 has a slit 213*a* through which the lap webbing 41 is passed just like the aforementioned embodiment.

In the casing 212, a tongue pipe 215 is disposed on a side of the tongue plate 211 and the hanger portion 213. The tongue pipe 215 is fixed to the casing 212 by rivets 216. The gas inlet 77 of the bag is connected to the upper end of the tongue pipe 215 by a band 217 in the same manner as the aforementioned embodiment. The inside of the tongue pipe 215 communicates with the inside of the bag in the same manner as the aforementioned embodiment described above. The lower end of the tongue pipe 215 projects outside the casing 212. A tongue cap 218 made of aluminum is fitted on the lower end opening of the tongue pipe 215. This tongue cap 218 has a bottom 218*a* formed in a concave spherical shape. The bottom 218*a* is formed with tear lines. The tongue cap 218 also functions as a screen gate or protective cover for preventing dust from invading into the tongue pipe 215.

The buckle 240 has an outer casing 242. The casing 242 is formed at its upper portion with an upper opening 242*a* into which the tongue plate 211 is inserted. The tongue latching mechanism 250 for latching the inserted tongue plate 211 is disposed in the casing 242. A release button 242*b* is provided at the upper portion of the casing 242. As the button 242*b* is depressed, the tongue latching mechanism 250 is released so as to pushed out the tongue 210 upwardly.

The tongue latching mechanism 250 functions in the same basic manner as the tongue latching mechanism 110 described above.

A buckle pipe 245 is disposed on a side of the tongue latching mechanism 250 of the buckle 240 (on the lower side in FIG. 8, on the left side in FIG. 9). The buckle pipe 245 is fixed to a retainer 249 inside the casing 242 by rivets 244. A buckle cap 248 made of aluminum is fitted on the upper end of the buckle pipe 245. The buckle cap 248 has a top surface 248*a* which is formed in a convex spherical shape. The top surface 248*a* is formed with tear lines.

Figures 10A, 10B, 10C:
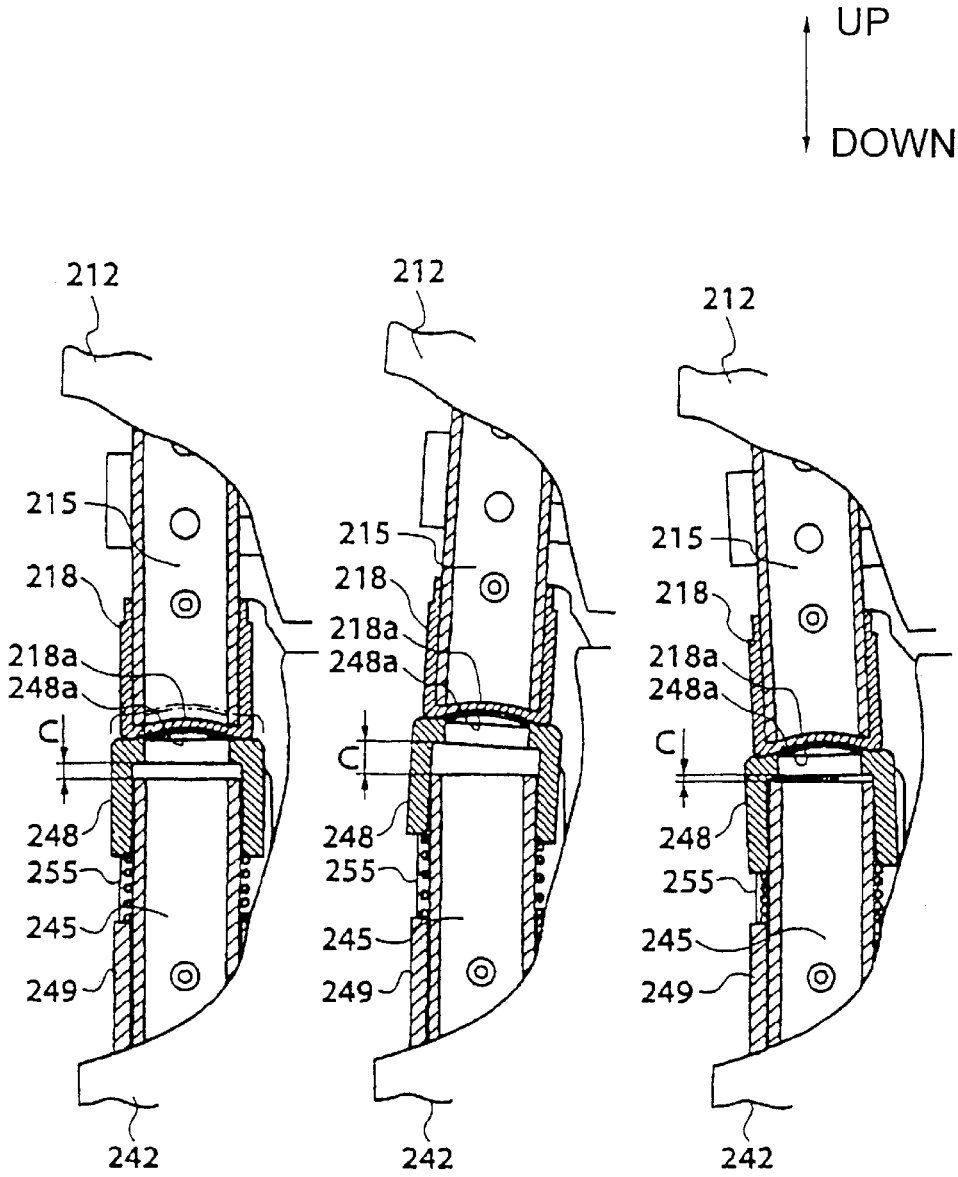
FIGS. 10(A)–10(C) are enlarged sectional views showing the joint portion between a buckle pipe and a tongue pipe in the latched state of the latching apparatus.
Figures 11A, 11B:
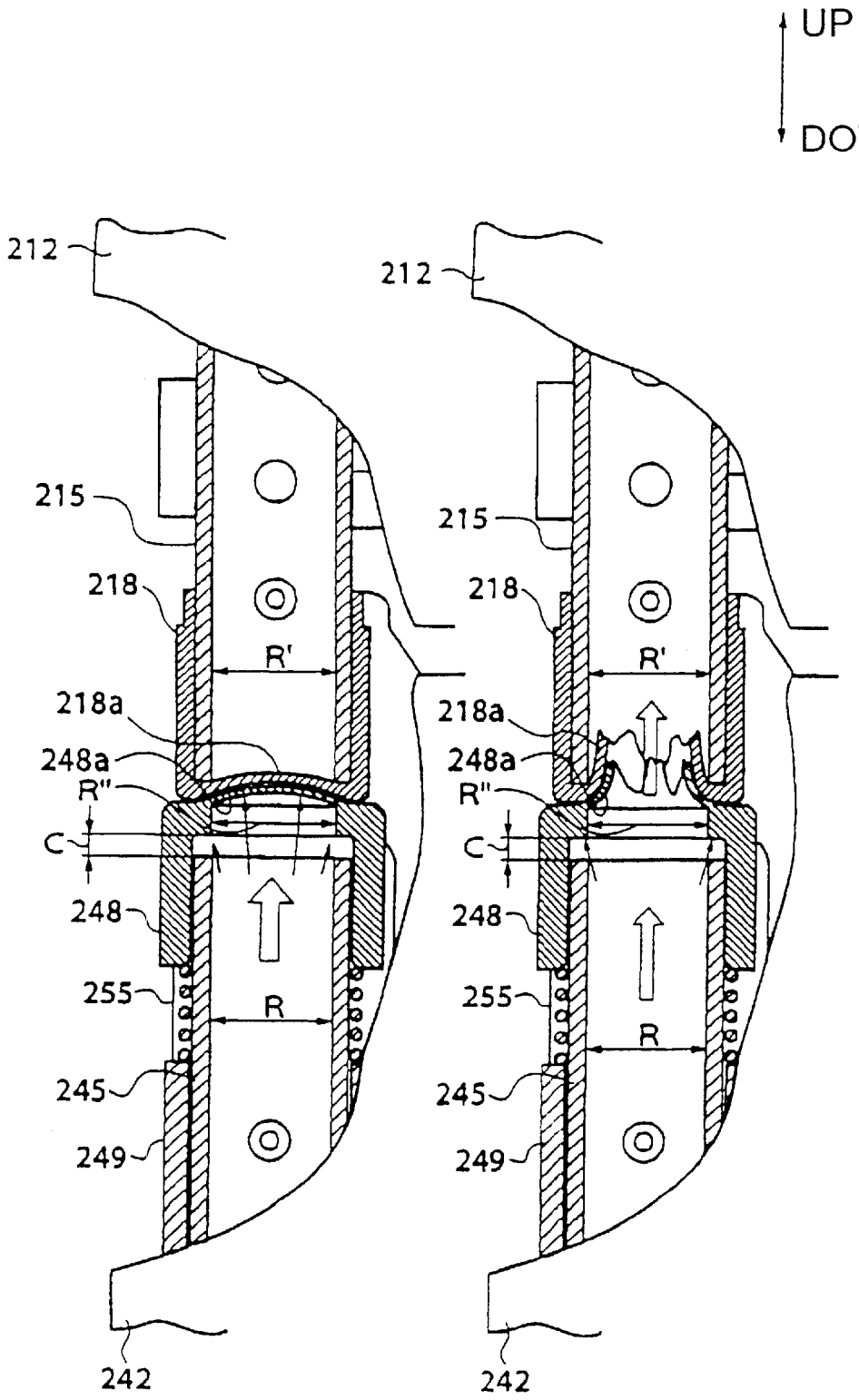
FIGS. 11(A), 11(B) are enlarged sectional views showing the flow of gas at the joint of the pipes in the latched state of the latching apparatus for the inflatable belt device.

As shown in FIGS. 11(A) and 11(B), the inner diameter R of the buckle pipe 245, the inner diameter R'of the tongue pipe 215, and the inner diameter R" of the buckle cap 248 are designed to be equal (for example, 9.6 mm). There is a clearance or gap (over stroke) C between the inner surface of the buckle cap 248 and the upper end of the buckle pipe 245 as shown in FIGS. 10(A) through 10(C). The clearance C absorbs the tolerance among parts and backlash during the insertion or tilting of the tongue 210. The buckle cap 248 is biased upwardly by a spring 255 fitted around the buckle pipe 245. Because of the biasing force of the spring 255, the upper end of the buckle pipe 245 and the lower end of the tongue pipe 215 are closely in contact with each other when the tongue 210 is latched (in the state shown in FIG. 9).

In the casing 242 of the buckle 240, the upper end of the inflator 239 is connected to the lower end of the buckle pipe 245. The inflator 239 includes a propellant, an initiator (not shown) therein. As the inflator 239 is ignited in the event of vehicle collision, the inflator 239 produces gas for deploying the bag into the buckle pipe 245. The gas passes into the hollow portion of the bag through the tongue pipe 215 of the tongue 210 after passing through the inside of the buckle pipe 245.

This embodiment is designed so that the tongue pipe 215 of the tongue 210 and the buckle pipe 245 of the buckle 240 are substantially coaxially aligned and connected to each other at the side of the latching apparatus 200 when the tongue 210 is latched (in the state shown in FIG. 9). The bottom 218*a* of the tongue cap 218 beneath the lower end of the tongue pipe 215 and the top 248*a* of the buckle cap 248 of the buckle pipe 245 are in closely contact with each other because of the concave spherical shape of the bottom 218*a* and the convex spherical shape of the top 248*a* as clearly shown in FIG. 10(A). The buckle cap 248 is biased toward the tongue cap 218 by the spring 255. Therefore, the space between the pipes 215, 245 is eliminated.

When the tongue 210 tilts rightward relative to the buckle 240, as shown in FIG. 10(B), the tongue pipe 215 and the buckle pipe 245 have a tilt angle therebetween so that the tongue pipe 215 and the buckle pipe 245 are not coaxially arranged. However, at this point, the bottom 215*a* of the tongue pipe 215 having the concave spherical shape is followed by the top 245*a* of the buckle pipe 245 because the top 245*a* has the convex spherical shape that is hard to deform against outer force from the above. The same is true for a case that the tongue 210 tilts leftward relative to the buckle 240 as shown in FIG. 10(C). Therefore, even when there is a tilt between the tongue pipe 215 and the buckle pipe 245, no space is created between the caps 218 and 248. It should be noted that the tilt of the buckle cap 248 itself is absorbed by the clearance C in the cap.

The joint portion between the tongue pipe 215 and the buckle pipe 245 is normally closed by the respective caps 218, 248 as shown in FIG. 11(A). However, when the inflatable belt is actuated, the caps 218, 248 are broken along their tear lines by gas pressure produced by the inflator 239. During this, the clearance at the joint portion is further compressed by the pressure of the gas, thus further reducing the possibility of gas leakage during the actuation of the inflator 239. After the caps 218, 248 are broken along their tear lines so as to allow the communication between the tongue pipe 215 and the buckle pipe 245, the gas from the inflator 239 is supplied into the bag through the inside of the pipes.

Since the inner diameter of the pipes 215, 245, and the inner diameter of the buckle cap 248 are equal (R=R'=R"), the flow passage area at the upstream (the tongue pipe 215) side and the flow passage area at the downstream (the buckle pipe 245) side relative to the joint portion of the caps 218, 248 are constant. Even when there is a tilt between the tongue pipe 215 and the buckle pipe 245, no space is created at the joint portion thereof as mentioned above. Therefore, there is no possibility of turbulence generation in the gas flowing inside the pipes so that the gas can smoothly flow and the gas can reach the inside of the bag without delay.

Figure 12:
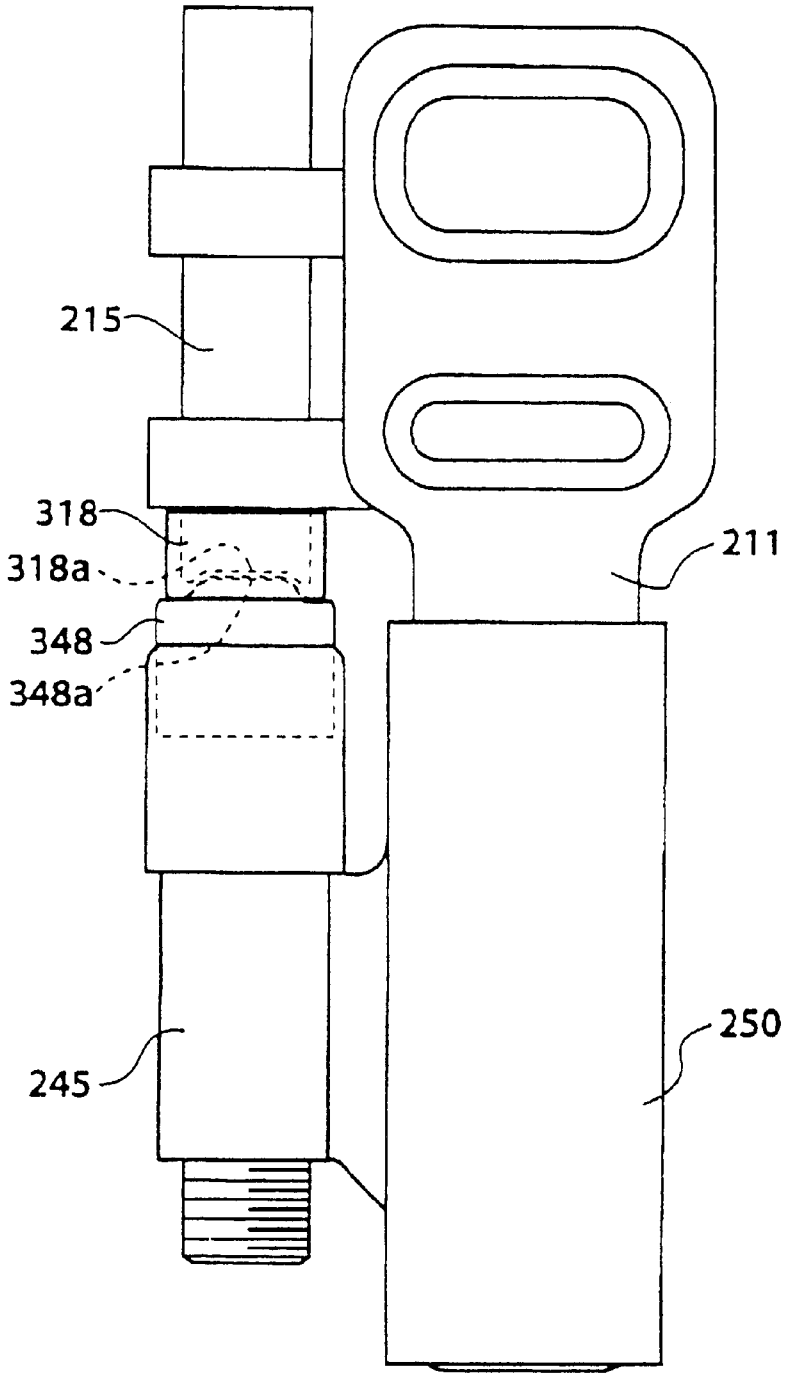
FIG. 12 is a front view showing a variation of the latching apparatus for the inflatable belt device shown in FIG. 8.
Figure 13:
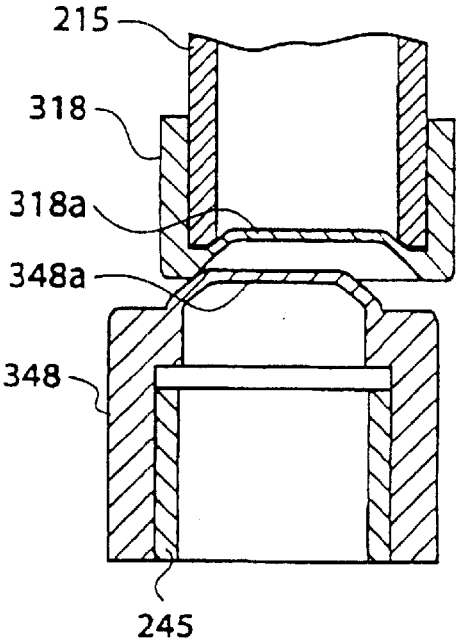
FIGS. 13(A) through 13(C) are enlarged views showing a joint portion between a buckle pipe and a tongue pipe of the latching apparatus shown in FIG. 12.

Description will now be made as regard to a variation of caps with reference to FIG. 12 through FIG. 13(C).

A buckle cap 348 shown in these drawings has a top 348*a* formed in a convex shape having a tapered surface. On the other hand, a tongue pipe cap 318 has a bottom 318*a* formed in a concave shape having a tapered surface. The top 348*a* and the bottom 318*a* are formed with tear lines, respectively, just like the aforementioned embodiments.

Figure 13C:
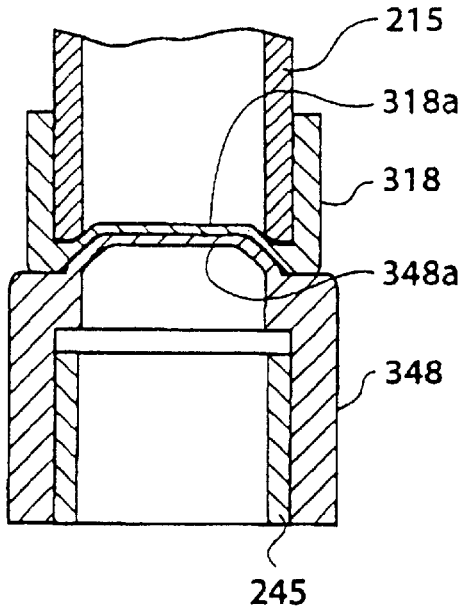
Figure 13B:
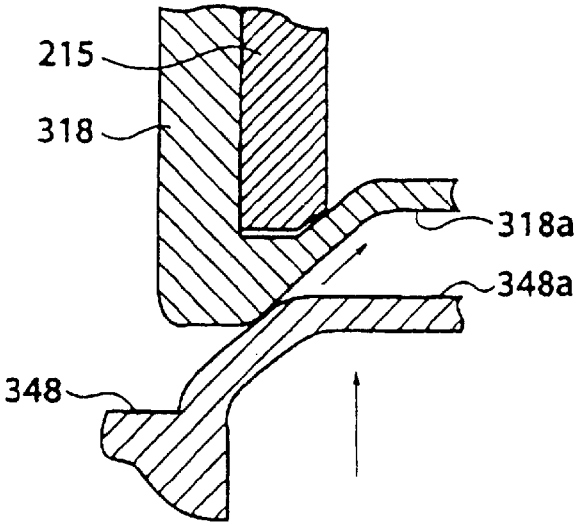

According to the buckle cap 348 and the tongue pipe cap 318 having such tapered surfaces, even when the buckle pipe 245 and the tongue pipe 215 are shifted from each other as shown in FIG. 13(A), the tapered surfaces of the caps 318, 348 slide relative to each other as shown in FIG. 13(B) so that the caps 318, 348 are aligned with each other about the center as shown in FIG. 13(C). Therefore, no space is created at the joint portion between the buckle pipe 245 and the tongue pipe 215.

As apparent from the above description, the present invention can provide a latching apparatus for an inflatable belt device which achieves reduction in the gas leakage without losing the smoothness of insertion of a tongue into a buckle, or which achieves reduction in the manufacturing cost and the weight of the latching apparatus.

When the inner diameter of the buckle pipe cap is designed to have substantially the same diameter as the inner diameter of the tongue pipe and the buckle pipe, the flow passage area at the tongue pipe side and the flow passage area at the buckle pipe side are constant. Therefore, there is no possibility of turbulence generation in gas flowing from the inflator to the inside of the bag so that the gas can smoothly flow.

When the top of the buckle pipe cap is formed in a convex spherical shape and the bottom of the tongue pipe cap is formed in a concave spherical shape corresponding to the configuration of the top of the buckle pipe cap, or when the top of the buckle pipe cap is formed in a convex shape having a tapered surface and the bottom of the tongue pipe cap is formed in a concave shape having a tapered surface corresponding to the configuration of the top of the buckle pipe cap, even if there is tilt between the tongue pipe and the buckle pipe, the lower end of the tongue pipe is followed by the upper end of the buckle pipe and these are aligned with each other about the center. Therefore, no space is created at the joint portion between the pipes.

The priority documents, Japanese Patent Application No. 2000-56621 filed Mar. 2, 2000 and No. 2000-347772 filed Nov. 15, 2000 are incorporated by reference herein in their entirety.

I claim:

1. A latching apparatus for an inflatable belt device comprising:

a tongue having a tongue pipe and being connected to an end of an inflatable belt;

a buckle having a buckle pipe and configured for being latched together with the tongue;

wherein the tongue pipe and the buckle pipe are configured to be substantially coaxially aligned and connected to each other when the tongue is latched to the buckle, so that gas for deploying the inflatable belt may pass from the buckle to the tongue, and wherein a connecting member is provided between the pipes, the connecting member biased in a direction from the buckle toward the tongue to eliminate a space between the pipes.

2. The latching apparatus of claim 1, wherein said connecting member comprises:

a buckle pipe cap which is fitted on the upper end of said buckle pipe and is configured to break when an inflator is actuated, and a spring for biasing the buckle pipe cap into contact with the lower end of the tongue pipe.

3. The latching apparatus of claim 2, wherein the inner diameter of said buckle pipe cap is substantially equal to the inner diameter of said tongue pipe and said buckle pipe.

4. The latching apparatus or claim 3, wherein said connecting member further comprises a tongue pipe cap which is fitted on the lower end of said tongue pipe and is configured to rupture when the inflator is actuated.

5. The latching apparatus of claim 4, wherein the top of the buckle pipe cap is formed in a convex shape and the bottom of said tongue pipe cap is formed in a concave shape.

6. The latching apparatus of claim 4, wherein the top of said buckle pipe cap is formed in a convex spherical shape and the bottom of said tongue pipe cap is formed in a concave spherical shape corresponding to the configuration of the top of said buckle pipe cap.

7. The latching apparatus of claim 4, wherein the top of said buckle pipe cap is formed in a convex shape having a tapered surface and the bottom of said tongue pipe cap is formed in a concave shape having a tapered surface corresponding to the configuration of the top of said buckle pipe cap.

* * * * *